United States Patent [19]

Downey

[11] 4,387,847

[45] Jun. 14, 1983

[54] CONTAINER FOR STORING PARTICULATE MATERIALS

[76] Inventor: Donald O. Downey, 207 Sharp St., Strasburg, Va. 22657

[21] Appl. No.: 160,925

[22] Filed: Jun. 19, 1980

[51] Int. Cl.[3] ..... B65D 91/00

[52] U.S. Cl. ..... 232/43.1; 232/43.2

[58] Field of Search ..... 232/43.1, 43.2, 43.3, 232/44, 48, 49, 50

[56] References Cited

U.S. PATENT DOCUMENTS

| | | | |
|---|---|---|---|
| 1,068,854 | 7/1913 | Garden | 232/43.3 |
| 1,238,010 | 8/1917 | Fisher | 232/43.3 |
| 1,459,096 | 6/1923 | Gibbons | 232/43.2 X |
| 1,694,347 | 12/1928 | Symonds et al. | 232/44 X |
| 2,110,773 | 3/1938 | Nelson | 232/43.2 |
| 2,170,677 | 8/1939 | Berg | 232/43.2 |
| 2,661,747 | 12/1953 | Manion | 232/43.2 X |
| 2,675,122 | 4/1954 | Minnie | 232/43.1 |
| 3,709,427 | 1/1973 | McGregor | 232/50 X |
| 3,814,149 | 6/1974 | Dunavant | 232/43.1 |

FOREIGN PATENT DOCUMENTS

| | | | |
|---|---|---|---|
| 461912 | 1/1914 | France | 232/50 |
| 128112 | 5/1950 | Sweden | 232/43.1 |
| 798271 | 7/1958 | United Kingdom | 232/43.1 |

*Primary Examiner*—Francis K. Zugel
*Assistant Examiner*—Peter A. Aschenbrenn
*Attorney, Agent, or Firm*—Birch, Stewart, Kolasch & Birch

[57] ABSTRACT

An improved container for loading, storing and/or transporting materials, particularly particulate materials which give rise to airborne contaminants when they are handled. The improved container of the present invention includes a container body having an opening on one sidewall thereof, deflection means arranged inside of the container for directing airborne contaminants disposed inside of the container away from the opening and a door member pivotally connected with the container. The door member is pivotal between a generally horizontal open position wherein the door member cooperates with the deflection means to direct airborne contaminants inside of the container away from the opening and to substantially separate the interior of the container from the opening and a closed position wherein the door member substantially closes the opening.

8 Claims, 6 Drawing Figures

CONTAINER FOR STORING PARTICULATE MATERIALS

BACKGROUND OF THE INVENTION

1. Field of the Invention

The present invention relates generally to containers for loading, storing and/or transporting particulate materials such as coals and ashes which give rise to airborne contaminants or particles when handled.

2. Description of the Prior Art

Various containers for loading, storing and transporting materials are known in the art. Containers for loading and transporting ashes are also known as evidenced by the Swedish Pat. No. 128,112. One problem associated with loading ashes into a container is that when the ashes are introduced into the container ash dust and/or smoke escape from the container and therefore limit the usefulness of these containers indoors, i.e., such as for removing coals and ashes from residential indoor fireplaces or wood or coal stoves. Containers which prevent the escape of smoke from ash trays and the like are also known in the art. These types of containers generally have an opening in the top into which a cigarette or cigarette ashes are inserted. The cigarette and/or ashes then fall into the container and means are often provided for preventing the escape of smoke from the container through the opening.

SUMMARY OF THE INVENTION

Accordingly, the improved container of the present invention has been developed in order to overcome the abovementioned problems associated with prior art containers.

The present invention is therefore directed to an improved container for loading, storing and/or transporting materials, particularly particulate materials which give rise to airborne contaminants when they are handled. The improved container of the present invention includes a container body having an opening on one sidewall thereof, deflection means arranged inside of the container for directing airborne contaminants disposed inside of the container away from the opening and a door member pivotally connected with the container. The door member is pivotal between a generally horizontal open position wherein the door member cooperates with the deflection means to direct airborne contaminants inside of the container away from the opening and to substantially separate the interior of the container from the opening and a closed position wherein the door member substantially closes the opening.

It is therefore a primary object of the present invention to provide a container for loading, storing and/or transporting ashes, coals or similar materials which allows the ashes or coals to be loaded into the container without ashes or smoke escaping into the surrounding atmosphere.

BRIEF DESCRIPTION OF THE DRAWINGS

Other objects and advantages of the present invention will become apparent from a study of the following drawing in which.

DETAILED DESCRIPTION OF THE INVENTION

Figure 2:
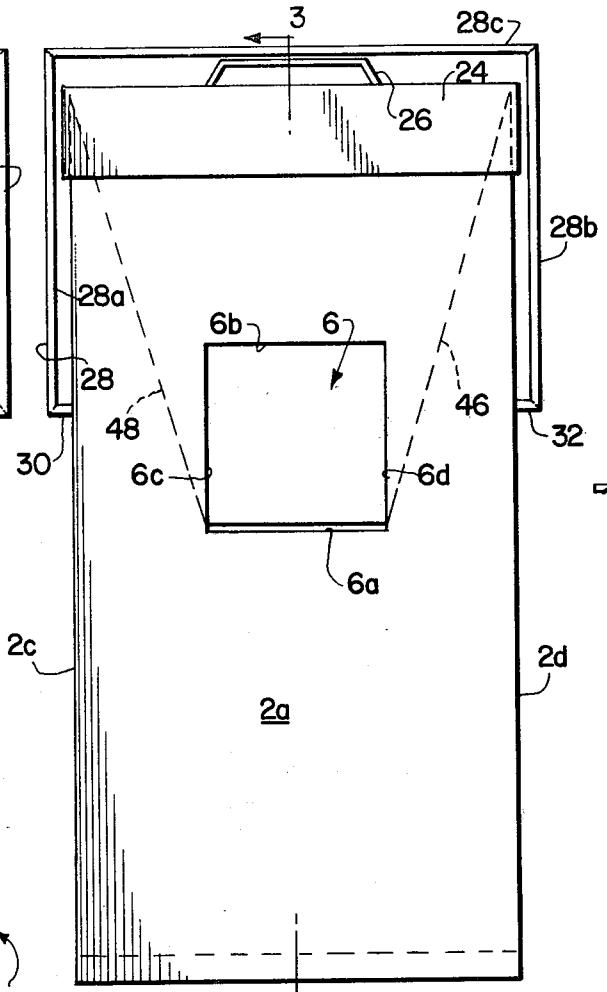
FIG. 2 is a front elevational view of the container of FIG. 1 with the door removed and with the cover in place.

As shown in FIGS. 1-4, the container includes a generally boxed shaped container body portion 2 made from a heat and/or fire resistant material such as sheet metal having an open top which includes a generally rectangular front wall 2*a*, a generally rectangular back wall 2*b*, a pair of generally rectangular side walls 2*c* and 2*d* and a rectangular bottom wall 2*e*. The bottom wall 2*e* is connected with the lower portions of the front, back and side walls to close the bottom of the container. The bottom wall 2*e* is spaced vertically above the lower edges of the front, back and side walls to define a space beneath the bottom wall at the lower end of the container. An insulating or fire retardant material 4 is provided in the space underneath the bottom wall 2*e* to prevent excessive heat from being transferred to the floor or to the area which supports the container when the container is being loaded with hot materials such as coals. The front wall 2*a* of the container includes a generally rectangular opening 6 which has a generally straight horizontal lower edge 6*a*, a generally horizontal straight upper edge 6*b*, and a pair of generally vertical straight side edges 6*c* and 6*d* as shown in FIG. 2. The container further includes a generally rectangular planar door member 8 which has an upper surface 8*a* and a lower surface 8*b*. A hinge 10, which is attached to the lower surface of the door member, pivotally connects the door member 8 with the lower edge 6*a* of the opening thereby separating the door into an outer portion 8*d* and an inner portion 8*e*. The door member 8 further includes a pair of sealing flanges 12 which are attached to the upper surface 8*a* of the outer portion 8*d* of the door member. The two flanges 12 are parallel and are spaced from each other a distance slightly smaller than the distance between the opening side edges 6*c* and 6*d*. The sealing flanges are orthogonally arranged relative to the door member and have a length slightly smaller than the side edges 6*c* and 6*d* of the opening.

Figure 3:
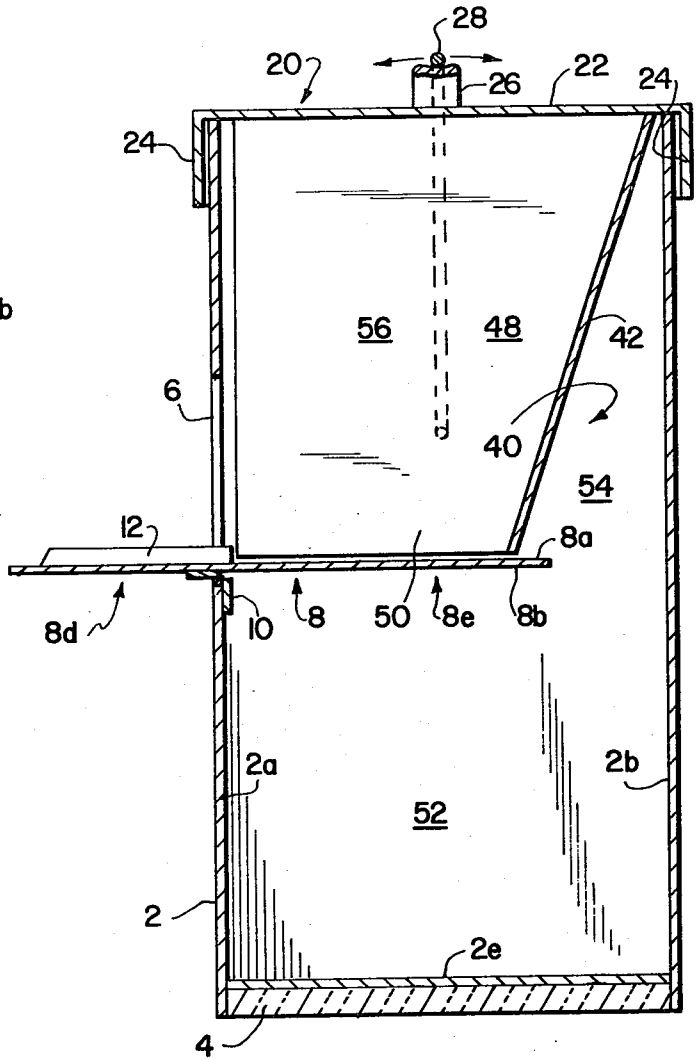
FIG. 3 is a cross sectional view taken through line 3—3 of FIG. 2 in which the door is in place and is in the open position.
Figure 1:
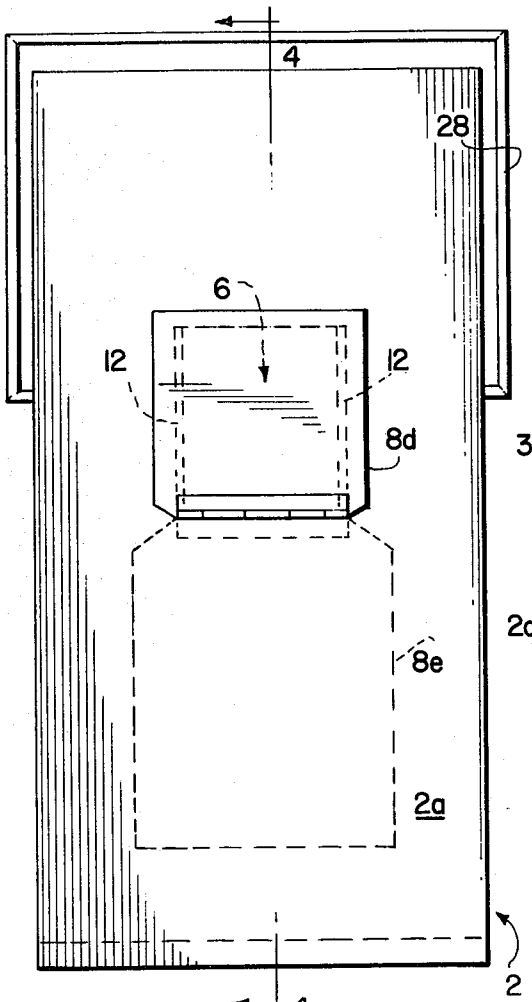
FIG. 1 is a front elevational view of the container of the present invention with the door in the closed position and with the cover removed.
Figure 6:
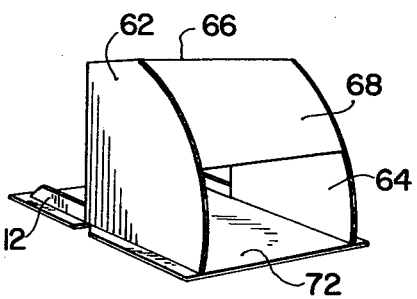
FIG. 6 is a perspective view of the improved door of FIG. 5.
Figure 4:
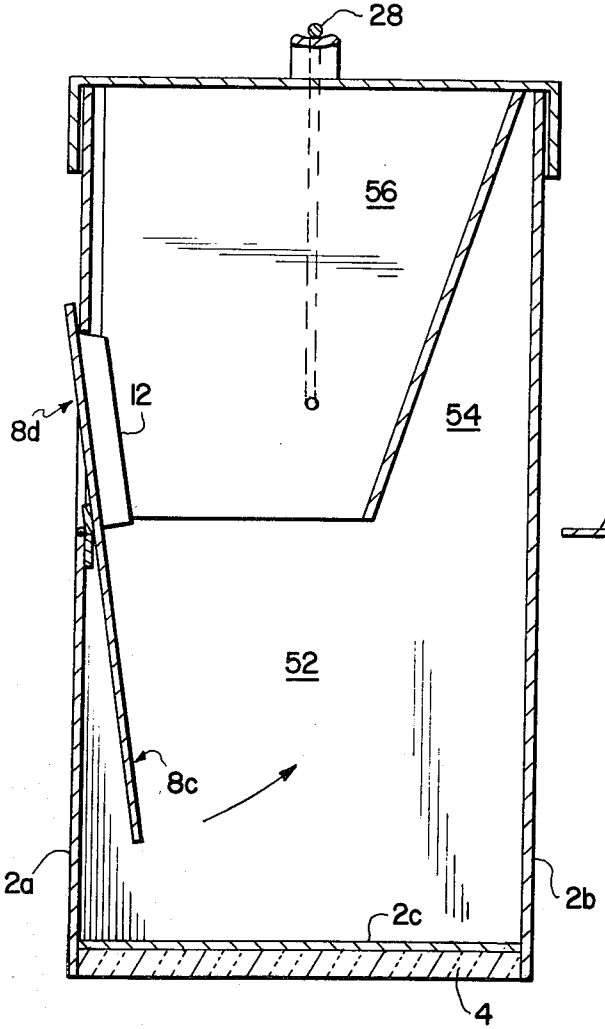
FIG. 4 is a cross sectional view along line 4—4 of FIG. 1 with the cover in place.

As shown in FIG. 1, the outer portion 8*d* of the door member is larger than the opening 6 in the side wall. Therefore, when the door member is in the closed position as shown in FIGS. 1 and 4, the outer portion 8*d* of the door member completely covers the opening 6 and thereby prevents the escape of ashes and/or smoke from the interior of the container. A latch may be provided on the door member to hold the door in the closed position. When the door member is in the closed position, the flanges 12 are located between and adjacent to the side edges 6*c* and 6*d*, respectively, of the opening thereby further preventing the escape of ashes and smoke from the interior of the container. As shown in FIG. 3, the container further includes a cover member 20 which closes the open top end of the container body 2. The cover includes a generally rectangular top portion 22 and a plurality of downwardly extending lips 24 which are connected to the outer edges of the top portion 22. A handle 26 is attached to the upper surface of the cover. Handle 28 is pivotally connected with the side walls of the container at pivot points 30 and 32. The handle 28 includes a pair of side arms 28*a* and 28*b* and a top arm 28*c* which cooperates with the handle 26 of the cover member to securely hold the cover member on the container body. Smoke deflection means 40 is attached to the lower surface of the cover member for directing smoke away from the opening 6. The smoke deflection means converges downwardly from the cover member 22. In the embodiment of FIGS. 2–4 the smoke deflector means includes a back smoke deflection plate 42 and pair of spaced downwardly converging smoke deflection side plates 46 and 48. The plates 42, 46 and 48 converge downwardly together in the general shape of a three sided or partial inverted truncated pyramid. The lower truncated portion of the pyramid defines an opening 50 at the bottom of the smoke deflection means. The front portions of side walls 46 and 48 are located adjacent to the inner surface of the front wall 2*a* of the container on opposite sides respectively of the opening 6 to prevent smoke from escaping through the opening. The lower extremity of the smoke deflection means is located at approximately the same height or vertical orientation as the lower edge of the opening 6. Therefore, when the door member 8 is pivoted from the closed position, as shown in FIG. 4, to the open position as shown in FIG. 3, the inner portion 8*e* of the door abutts the lower portion of the smoke deflection means and assumes a generally horizontal orientation. The lower portions of the side walls 46 and 48 and the lower portion of the backwall 42 cooperate with the inner portion 8*e* of the door to substantially separate the interior of the container, where the ashes are stored, from the opening 6 and to direct smoke away from the opening.

As shown in FIG. 3, the door member 8 and the smoke deflection means 40 substantially separate the container 2 into; a collection chamber 52 located substantially below the lower edge 6*a* of the opening; a smoke deflection chamber 54 located between the walls 42, 46 and 48 of the smoke deflection means and the walls 2*b*, 2*d*, and 2*c*, respectively, of the container 2 and above the lower edge 6*a* of the opening; and a loading chamber 56 located substantially inside of the smoke deflection means. When the door member is in the horizontal open position, the door member 8 and the smoke deflection means 40 cooperate to substantially separate the loading chamber 56 from the collection chamber 52 and the deflection chamber 54.

Figure 5:
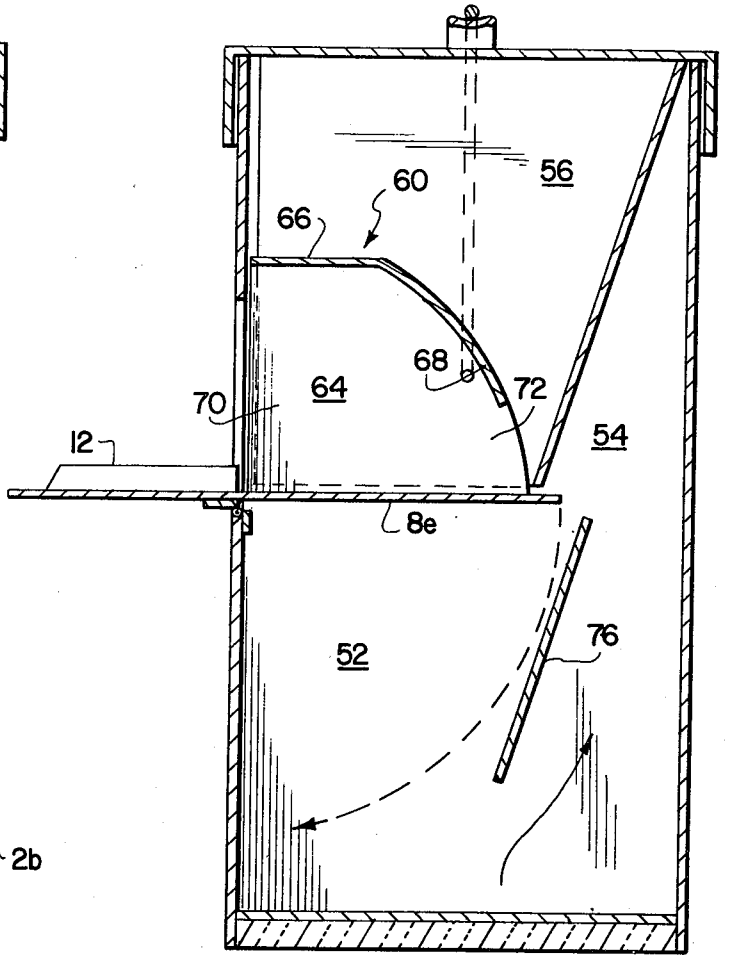
FIG. 5 is a cross sectional view similar to FIG. 3 of a second embodiment of the present invention.

In the embodiment of FIG. 5, a box-like enclosure or delivery chute is provided on the upper surface of the inner portion of the door member 8. The box-like portion 60 includes a pair of upstanding side walls 62 and 64, a top wall 66 and curved back wall 68. The side walls 62 and 64, the top wall 66, the back wall 68 and the inner portion 8*e* of the door define a chute having a front loading opening 70 which is larger than the sidewall opening 6 and a back dumping or delivery opening 72. The container body portion is also provided with a smoke deflecting baffle 76 which is located in the collection chamber 52 and which is connected between the sidewalls 2*c* and 2*d* of the container body. The smoke deflecting baffle 76 is angled upwardly and away from the opening 6 to further direct smoke away from the opening.

In operation, the ashes are loaded with a shovel onto the outer portion 8*d* and/or onto the inner portion 8*e* of the door member when the door is in the generally horizontal open position as shown in FIG. 2. The ashes are thereby disposed on the door 8 and in the loading chamber 56. The door is then pivoted to the closed position shown in FIG. 4 whereby the ashes are dumped into the collection chamber 52 of the container body. During the dumping procedure, the flanges 12 function to contain the ashes and/or coals on the outer portion 8*d* of the door member.

When the door is pivoted, the flanges 12 help to direct the ashes downwardly along the door into the collection chamber of the container body. After dumping, when the door is in the substantially vertical, closed position, the flanges 12 function to seal the inner edges of side edges 6*c* and 6*d* of the opening 6 and prevent ashes and/or smoke from escaping from the container. When the container is full or when the ashes and dust have settled, the cover member, which includes the smoke deflecting means, is removed to lighten the overall weight of the container and the container is carried by the handle 28 to a convenient site for emptying the container. The container may also be carried by handles 26 and 28 simultaneously with the cover in place.

In the embodiment of FIG. 5, the ashes are loaded onto the door and the door is then swung to the closed position whereby the ashes slide from the outer portion of the door through the front loading opening 70 to the inner portion of the door and pass through the inner delivery opening 72 of the box-like structure. When the door member 8 is in the closed position, the curved back plate 68 and the side plates 62 and 64 of the box-like enclosure also function to direct smoke away from the opening 6.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A container for loading, storing and/or transporting particulate material such as ashes, coals or similar materials while preventing airborne contaminants such as smoke escaping therefrom, said container comprising:

(a) a container body comprising a front wall, a back wall, a pair of sidewalls, a bottom and an open top, said bottom wall being connected with the lower portions of said front, back and sidewalls to form the bottom of said container body, said container body being provided with an opening in said front wall having a generally horizontal lower edge;

(b) a removable cover member which closes said open top of said container body;

(c) deflection means attached to the lower surface of said cover member having a lower extremity which converges downward within said container body;

(d) a door member pivotally connected intermediate its ends along said lower edge of said front wall opening, to divide said door member into an outer portion larger than said front wall opening and an inner portion, said door member being pivoted from an open loading position wherein the outer portion of said door is substantially horizontal such that said particulate material can be disposed on said outer portion, said door member in said open loading position together with said deflection means dividing said container body into a loading chamber, a collection chamber and a deflection chamber, to a dumping position wherein said particulate material is dumped into said collection chamber, to a closed position wherein said outer portion of said door member closes said front wall opening.

2. A container as defined in claim 1, wherein said lower extremity of said deflection means is arranged at about the same vertical orientation as said lower edge of said front wall opening.

3. The container as defined in claim 2, wherein said collection chamber is located substantially below the lower edge of said front wall opening; said deflection chamber is located substantially above the lower edge of said front wall opening, between said deflection means, the sidewalls of said container and said back wall away from said opening; and said loading chamber is located substantially above the lower edge of said front wall opening in front of said deflection means wherein said deflection means and said inner portion of said door member cooperate to substantially separate said collection chamber and said deflection chamber from said loading chamber when said door member is in said open position.

4. A container as defined in claim 1, wherein said deflection means includes a pair of spaced downwardly converging deflection plates, at least a portion of said plates being arranged adjacent to and on opposite sides of said front wall opening.

5. A container as defined in claim 1, wherein said door member includes an upper and a lower surface, said upper surface of said outer portion of said door member further including sealing means for sealing at least a portion of said front wall opening when said door member is in the closed position, said sealing means also functioning to contain said particulate material on said outer portion of said door member when said door member is in the open position.

6. A container as defined in claim 1, wherein said upper surface of said inner portion of said door member further includes a delivery chute means having a loading opening and a delivery opening, said delivery chute means being located substantially in front of said deflection means when said door member is in said open position.

7. A container as defined in claim 6, wherein said loading opening of said delivery chute means is larger than said front wall opening.

8. A container defined in claim 5, wherein said sealing means comprises a pair of sealing flanges which seal opposing inner edges of said front wall opening.

* * * * *